US007447474B2

(12) United States Patent
Fujino

(10) Patent No.: US 7,447,474 B2
(45) Date of Patent: Nov. 4, 2008

(54) IMAGE HEATING APPARATUS WITH ADJUSTED FEEDING FORCE TO SHEET WITH TONER IMAGE

(75) Inventor: Takeshi Fujino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 11/414,173

(22) Filed: May 1, 2006

(65) Prior Publication Data

US 2006/0245800 A1 Nov. 2, 2006

(30) Foreign Application Priority Data

May 2, 2005 (JP) ..... 2005-134424

(51) Int. Cl.
*G03G 15/20* (2006.01)

(52) U.S. Cl. ..... 399/329

(58) Field of Classification Search ..... 399/328–329
See application file for complete search history.

(56) References Cited

U.S. PATENT DOCUMENTS 3,976,370 A * 8/1976 Goel et al. ..... 399/312
2005/0276624 A1 12/2005 Fujino ..... 399/69
2007/0059059 A1 3/2007 Fujino ..... 399/329

FOREIGN PATENT DOCUMENTS

JP 10-228199 8/1998
JP 2000293058 A * 10/2000
JP 2001-201979 7/2001
JP 2004226819 A * 8/2004

* cited by examiner

*Primary Examiner*—Ryan Gleitz
(74) *Attorney, Agent, or Firm*—Fitzpatrick, Cella, Harper & Scinto

(57) ABSTRACT

An image heating apparatus includes a heating rotatable member for forming a nip and heating an image on a recording material at the nip; an endless belt cooperative with the heating rotatable member to form the nip; and a pressing roller for pressing the belt toward the heating rotatable member at the nip, the roller having a diameter which is larger at an axially central portion thereof than at opposite end portions thereof and having a friction coefficient which is smaller at the axially central portion than at the opposite end portions.

3 Claims, 6 Drawing Sheets

IMAGE HEATING APPARATUS WITH ADJUSTED FEEDING FORCE TO SHEET WITH TONER IMAGE

FIELD OF THE INVENTION AND RELATED ART

The present invention relates to an image heating apparatus for heating an image on recording medium. Such an image heating apparatus is employed by a copying machine, a printing machine, a facsimile machine, etc.

A fixing apparatus which thermally fixes an unfixed toner image has long been employed by an image forming apparatus such as a copying machine, a printing machine, a facsimile machine, etc., which employs an electrophotographic image forming method. As an example of such a fixing apparatus, there is a fixing apparatus of the belt-nip type, which is made up of a fixation roller having a heat source, a pressure roller, and a fixation belt. The fixation belt is kept pressed upon the fixation roller by the pressure roller.

Japanese Laid-open Patent Application 10-228199 discloses a fixing apparatus of the belt-nip type. This fixing apparatus is made up of a fixation roller, an endless belt, and a pressure pad. The fixation roller is disposed outside the loop which the endless belt forms, whereas the pressure pad is disposed inside the loop. Further, the endless belt is pressed upon the fixation roller by the pressure pad. Thus, a fixation nip is formed between the fixation roller and the endless belt.

To describe this fixing apparatus in more detail with reference to FIG. 5, a belt 102 is stretched around, being thereby supported by, multiple rollers (103*a*, 103*b*, etc.). The belt 102 forms a fixation nip between itself and a fixation roller 101. The fixing apparatus is also provided with a pressure roller 103*a* and a pressure pad 104, which are on the exit side and entrance side, respectively, of the fixation nip.

In the case of the structural arrangement of the abovementioned fixing apparatus, high pressure is applied to the peripheral surface of the fixation roller 101, across the area next to the exit portion of the fixation nip. Therefore, this area of the peripheral surface of the fixation roller 101 is deformed, making it easier for recording medium to peel itself away from the fixation roller.

However, a fixing apparatus of the belt-nip type structured in accordance with the prior art is technically problematic in that it has a tendency to wrinkle recording medium, preventing thereby the unfixed image on the recording medium from being satisfactorily fixed to the recording medium.

As one of the fixing apparatuses devised to solve the above described problem, there is the fixing apparatus disclosed in Japanese Laid-open Patent Application 10-228199. Referring to FIG. 6, The pressure pad 104 of this fixing apparatus is structured so that, in terms of the pressure distribution of the pressure pad 104 in its lengthwise direction, the center portion of the pressure pad 104 generates a greater amount of pressure than the end portions of the pressure pad 104.

As a result, when the recording medium is conveyed through the fixation nip, the speed at which the end portions of the recording medium, in terms of the width direction of the recording medium, is conveyed becomes higher than the speed at which the center portion of the recording medium is conveyed (it is possible to think that because the center portion generates a greater amount of pressure than the lengthwise end portions, it is slower in the speed at which it conveys recording medium). With the lengthwise end portions of the fixation nip being faster in the recording medium conveyance speed, the lengthwise end portions of the recording medium are pulled in the direction to stretch the recording medium in the width direction of the recording medium (direction perpendicular to recording medium conveyance direction). Therefore, the possibility that the recording medium will be wrinkled is minimized.

On the other hand, the attempt to minimize the possibility that the recording medium will be wrinkled tends to make it difficult for the recording medium to separate from the fixation roller. In other words, the relationship between the object of minimizing the possibility that the recording medium will be wrinkled, and the object of making it easier for the recording medium to separate from the fixation roller is a trade-off. The cause of this trade-off is traceable to the difference in peripheral velocity between the center portion and each end portion, in terms of the direction parallel to its axial line, of the pressure roller 103*a*, which corresponds to the amount of the "crowning" of the pressure roller 103*a*. The following is the more detailed description of this trade-off.

The fixation roller 101 and pressure roller 103*a* are kept pressed against each other by the application of a preset amount of pressure. Therefore, they tend to deform in such a manner that their center portions, in terms of their axial direction, exert less contact pressure than the end portions. The amount of difference in contact pressure between their center portions and end portions is affected by the amount of the pressure applied to keep the two rollers kept pressed against each other, the diameter of each roller, the thickness of the elastic layer of each roller, the properties (Young s modulus) of the material for the elastic layer of each roller, etc.

Therefore, in the case of the heat roller 101 and pressure roller 103*a* which are uniform in diameter in terms of their lengthwise direction, the fixation nip created by the pressure roller 103*a* is narrower across the center portion (in terms of axial direction of two rollers) than the end portions. The difference in width between the center portion and lengthwise end portions of the fixation nip corresponds to the amount by which the center portion and end portions of each roller are deformed. In other words, the closer to the lengthwise end of the fixation nip, the wider a given point of the fixation nip.

In the case of a fixing apparatus such as the above described one, the fixation nip of which is shaped so that its lengthwise center portion is narrower than the lengthwise end portions, there is such a problem that the lengthwise center portion of the fixation nip is lower in recording medium releasing performance than the lengthwise end portions. As the solution to this problem, there is the fixing apparatus disclosed in Japanese Laid-open Patent Application 2001-201979. In the case of this fixing apparatus, its pressure roller 3*a* is "positively crowned", that is, the lengthwise center portion of its pressure roller 3*a* is rendered greater in diameter than the lengthwise end portions of its pressure roller 3*a*.

However, the prior art described above has the following problem.

That is, referring to FIG. 6, first, in the case of the fixing apparatus disclosed in Japanese Laid-open Patent Application 10-228199, only the ratio between the amount of the pressure P1 exerted by each of the lengthwise end portions of the pressure pad and the amount of the pressure P2 exerted by the center portion of the pressure pad is adjusted. However, it is difficult to accomplish both the object of preventing a fixing apparatus from causing an image from deviating in position, and the object of preventing a fixing apparatus from causing recording medium to wrinkle, by adjusting only the ratio between the pressures P1 and P2.

To describe more concretely, there is the following relationship between the effects (positional image deviation, and wrinkling of recording medium) of the pressure pad 104, and the ratio between the pressure P1, that is, the amount of pressure exerted by each of the lengthwise end portions of the pressure pad 104 (for simplification of description, it is assumed that both lengthwise ends of pressure pad 104 are roughly the same in the amount of pressure they exert) and the pressure P2, that is, the amount of pressure exerted by the center portion of the pressure pad 104:

when P1/P2>1.00, the positional image deviation does not occur, but the recording medium might develop wrinkles;

when P1/P2<0.75, the recording medium does not develop wrinkles, but the positional image deviation might occur;

when 0.75≦P1/P2≦1.00, neither the wrinkling of the recording medium, nor the positional image deviation occurs.

In other words, the fixing apparatus displays the above described tendencies (However, P1/P2 is affected by the structure of fixing apparatus; in other words, the above given numerical values are nothing but examples).

That is, the relationship between the pressure P1, or the pressure at each of the lengthwise ends of the pressure pad 104, and the pressure P2, or the pressure at the lengthwise center of the pressure pad 104, are such that the recording medium develops wrinkles when the pressure P1 is excessively high relative to the pressure P2, and also, such that the positional image deviation occurs when the pressure P1 is excessively low relative to the pressure P2. In other words, the relationship between the positional image deviation and wrinkling of recording medium is a trade-off.

As a narrow sheet of recording medium (for example, recording paper of A5 or B5 size, postcard, etc.) is conveyed through a fixing apparatus, the fixation nip of the fixing apparatus is divided into the range which comes into contact with the recording medium, and the range(s) which does not come into contact with the recording medium. Hereafter, the former range will be referred to as contact range, whereas the latter range will be referred to as non-contact range.

If multiple sheets of recording medium are continuously conveyed through a fixing apparatus in accordance with the prior art, the difference in temperature between the contact and non-contact ranges of the fixation nip of the fixing apparatus gradually widens (so-called non-contact range temperature increase phenomenon occurs). As this phenomenon occurs, the pressure P1, or the pressure at the lengthwise end portions of the fixation nip, becomes higher than the pressure P2, or the pressure at the center portion of the fixation nip, because of the thermal expansion of the rubber which is one of the essential materials for the structural components of the fixation roller 101 and pressure pad 104.

More specifically, during the initial stage of a fixing operation, P1/P2, which indicates the balance, in terms of the amount of the pressure exerted by the pressure pad 104, between the lengthwise end and center of the pressure pad 104, is 0.85 (P1/P2=0.85), which is satisfactory. However, with the progression of the fixing operation, the temperature of the non-contact range gradually increases, and therefore, the value of P1/P2 becomes close to 1.00, and in some cases, it exceeds 1.00. Thus, it is possible that as the fixing operation continues, the fixing apparatus will begin to cause the recording medium to develop wrinkles while it conveys the recording medium through it.

On the other hand, if a fixing apparatus is designed so that P1/P2 is very low in value at the beginning of the fixing operation, the apparatus tends to cause the positional image deviation, which is obvious, making it impossible to obtains a satisfactory image.

In the case of the structure disclosed in Japanese Laid-open Patent Application 2001-201979, it is difficult to improve a fixing apparatus in terms of recording medium release while preventing the pressure roller 103*a* of the fixing apparatus from causing the recording medium to develop wrinkles. Next, the reason why it is difficult will be described.

The pressure roller 103*a* is shaped so that its diameter gradually reduces, starting from the lengthwise center toward the lengthwise ends. Therefore, in terms of the lengthwise direction of the pressure roller 103*a*, the peripheral velocity of a given point of the peripheral surface of the pressure roller 103*a* is different from the peripheral velocity of another point, and the difference is proportional to the difference in diameter between the first and second points. Thus, the lengthwise end portions of the pressure roller 103*a* are slower in peripheral velocity than the lengthwise center portion of the pressure roller 103*a*. In other words, in the case of the fixing apparatus, the belt 102 of which is circularly moved by the rotation of the fixation roller 101 of the fixing apparatus, and the pressure roller 103*a* of which is rotated by the circular movement of the belt 102 of the fixing apparatus, the belt 102 becomes nonuniform in the velocity at which it is driven, in terms of the direction parallel to the axial line of the pressure roller 103*a*; the peripheral velocity at which a given point of the belt 102 is driven is different from that at which another point of the belt 102 in terms of the direction parallel to the axial line of the pressure roller 103*a* is driven. The extent of the nonuniformity corresponds to the nonuniformity in the diameter of the pressure roller 103*a*, in terms of the direction parallel to the abovementioned axial line.

In reality, however, the belt 102 reacts in a manner to cause a given point of the belt 102 and another point of the belt 102 in terms of the direction parallel to the axial line of the pressure roller 103 to move at the same velocity. As a result, during the period immediately after the belt 102 begins to be rotated, the belt 102 gradually deforms (it gradually becomes wavy) because of the above described difference in velocity between a given point and another. Eventually, the elasticity of the belt 102 reaches its limit, preventing thereby the belt 102 from further deforming. Thus, once the elasticity of the belt 102 reaches its limit, a given point of the belt 102, and another point of the belt 102 in terms of the direction parallel to the axial line of the pressure roller 103*a*, move at the same velocity, with the belt 102 remaining maximumly deformation.

In the areas in which the velocity of the pressure roller 103*a* is different from that of the belt 102, the belt 102 repeats the sequence of slipping on the pressure roller 3*a* and sticking to the pressure roller 3*a* (stick-and-slip phenomenon), in order to dissolve its deformation. In other words, the energy resulting from the above described velocity difference is converted into the stress accumulated in the form of the waving of the belt 102, and frictional heat. Reversely stating, if the endless belt 102 is continuously driven while being kept in the state in which the velocity at which the belt 102 is driven is nonuniform in terms of the direction parallel to the axial line of the pressure roller 103*a*, the elasticity of the endless belt 102 is eventually overcome by the stress and frictional heat; the belt 102 will split.

That is, the velocity difference, which results from the diameter difference in terms of direction parallel to the axial line of the pressure roller 103*a*, is converted into the lengthwise surface deformation of the endless belt 102, that is, the waving of the belt surface. The waving travels from the edges of the belt 102, which is slower in the velocity at which it is driven, to the center of the belt 102. The greater in magnitude the waving of the belt 102, the greater the possibility that the recording medium will be wrinkled while it is subjected to the fixation process in which it is pinched by the waving belt 102 and the pressure roller 103*a*.

In order to deal with the above described problem, Japanese Laid-open Patent Application 2001-201979 proposes to adjust the amounts by which the group of rollers (pressure rollers 103*a*, support roller 103*b*, and steering roller 103*c* (not shown in FIG. 5)), around which the belt 102 is stretched, are "crowned". More specifically, the amounts by which the rollers are "crowned" are adjusted so that $[\alpha-(\beta+\gamma)]=0$ is satisfied, wherein $\alpha$ stands for the amount by which the pressure roller 103*a* is "crowned", and $\beta$ and $\gamma$ stand for the amounts by which the support roller 103*b* and steering roller 103*c* are "reversely crowned".

That is, Japanese Laid-open Patent Application 2001-201979 states that the belt 102 can be prevented from waving, by "reversely crowing" the support roller 103*b* or steering roller 103*c* by the amount optimal to cancel the effect of the "crowning" of the pressure roller 103*a*.

However, the cause of the waving of the belt 102 is that the pressure roller 103*a*, the center portion of which is larger in diameter than the end portions thereof, in terms of the direction parallel to its axial line, is kept pressed against the fixation roller 101 with the belt 102 pinched between the pressure roller 103*a* and fixation roller 101. Therefore, reversely crowning the support roller 103*b* and steering roller 103*c* is not enough to completely solve the above described problem.

That is, the support roller 103*b* and steering roller 103*c* are not kept pressed against the fixation roller 101. Therefore, "reversely crowning" the support roller 103*b* and steering roller 103*c* does not guarantee that the belt 102 is deformed, that is, the belt 102 is caused to wave, by the nonuniformity in the velocity at which the belt 102 is driven, in terms of the direction parallel to the lengthwise direction of the belt 102. In other words, it does not guarantee that the "center-ward" deformation of the belt 102 caused by the pressure roller 103*a* is cancelled by the "edge-ward" deformation.

However, if the amount by which the pressure roller 103*a* is "positively crowned" is simply reduced as a measure to deal with the above described problem, the nip formed by the pressure roller 103*a* is reduced in width, across the center portion, decreasing thereby the efficiency with which the recording medium separates from the fixation roller 101.

To summarize the above description, as the means for preventing the recording medium from wrinkling while preventing the positional image deviation, adjusting the pressure distribution of the pressure pad 104 in terms of its lengthwise direction, and/or adjusting the amounts by which the group of rollers, around which an endless belt is stretched, are "crowned" is not sufficient.

SUMMARY OF THE INVENTION

The primary object of the present invention is to provide an image heating apparatus which does not wrinkle recording medium.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 1(*b*) is a schematic drawing showing the nonuniformity in the coefficient of the surface of the low friction sheet as the surface layer of the pressure pad, in terms of the direction parallel to the axial line of the pressure roller.

DETAILED DESCRIPTION OF THE PREFERRED EMBODIMENTS

Hereinafter, the preferred embodiments of the present invention will be described in detail with reference to the appended drawings. The measurements, materials, and shapes of the structural components of the apparatuses in this embodiment, and the positional relationship among the structural components, are not intended to limit the scope of the present invention, unless specifically noted. Further, if a given component of an apparatus in the following description of the preferred embodiments of the present invention is the same in material, shape, etc., as one of the components described in the preceding portion of the description, the former is identical to the latter unless specifically noted, and will be described.

Embodiment 1

(Fixing Apparatus)

Figure 2:
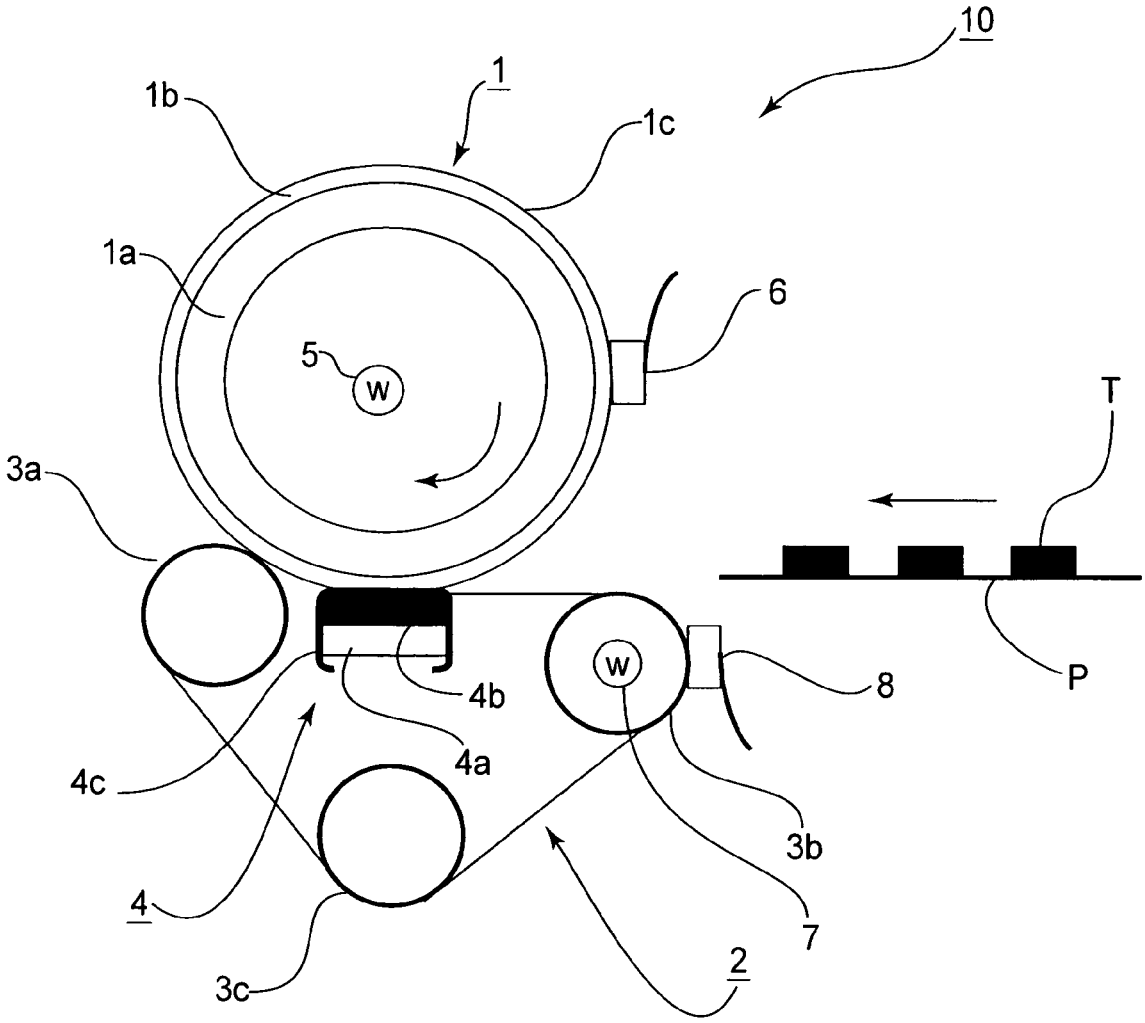
FIG. 2 is a schematic sectional view of the fixing apparatus in the first embodiment of the present invention.

FIG. 2 is a schematic sectional view of an image heating apparatus as a fixing apparatus.

The fixing apparatus 10 in this embodiment is provided with a fixation roller 1, an endless belt 2, a pressure roller 3*a*, a heat roller 3*b*, a steering roller 3*c*, and a pressure pad 4.

As shown in FIG. 2, the fixation roller 1 is a rotatable heating member which contains a heat source. The fixation roller 1 is rotationally driven by an unshown driving force source in the direction indicated by an arrow mark at a preset peripheral velocity. The fixation roller 1 is provided with a metallic core 1*a*. As the metallic core 1*a*, a rod formed of aluminum, iron, or the like is employed. The peripheral surface of the metallic core 1*a* is coated with an elastic layer 1*b* formed of silicone rubber, and the outward surface of the elastic layer 1*b* is coated with a release layer 1*c* formed of fluorinated resin.

Within the hollow of the metallic core 1*a*, a halogen lamp 5 as the heat source is disposed. The fixation roller 1 is heated from within by this halogen lamp 5. The surface temperature of the fixation roller 1 is detected by a temperature sensor 6, which is in contact with the roughly the lengthwise center portion of the fixation roller 1. The halogen lamp 5 is controlled by an unshown temperature controlling apparatus so that the surface temperature of the fixation roller remains at 150°, for example.

In the area below the fixation roller 1, the endless belt 2, pressure pad 4, and pressure roller 3*a* are disposed so that the pressure pad 4 is pressed against the fixation roller 1, with the endless belt 2 pinched between the pressure pad 4 and fixation roller 1, in order to form a nip with a preset amount of width. In the nip (fixation nip), an unfixed toner image formed on a recording medium P is fixed while the recording medium P and the unfixed toner image thereon are moved through the nip.

The endless belt 2 is formed of polyimide film or the like. It is 100 μm in thickness, 320 mm in width, and 188 mm in circumferential length. It is stretched around three supporting rollers, that is, the pressure roller 3*a*, heat roller 3*b*, and steering roller 3*c*, and is kept stretched by the application of 120 N of tensional force. The belt 2 is rotated by the rotation of the fixation roller 1 through the contact between the belt 2 and fixation roller 1. The pressure roller 3*a*, which will be described later, is rotated by the circular movement of the belt 2 through the contact between the pressure roller 3*a*, and the belt 2 which is rotated by the rotation of the fixation roller 1.

The pressure roller 3*a* presses on the fixation roller 1 with the presence of the endless belt 2 between the two rollers 3*a* and 1. The heat roller 3*b* heats the endless belt 2 by being heated by a heat source 7, such as a halogen heater, disposed in the hollow of the heat roller 3*b*, while being controlled in temperature based on the temperature detected by a temperature sensor 8. The steering roller 3*c* adjusts the endless belt 2 in the movement in the direction parallel to the lengthwise direction of the endless belt 2; the movement of the endless belt 2 in the direction parallel to the lengthwise direction of the endless belt 2 is controlled by tilting the shaft of the steering roller 3*c* with the use of an unshown mechanical power source and an unshown controlling apparatus.

The abovementioned three rollers 3*a*, 3*b*, and 3*c* are in the form of a cylinder or a circular pillar, and is formed of stainless steel, iron, or the like. They are 18 mm in diameter.

The fixing apparatus is structured so that pressure is applied to the lengthwise end portions of the pressure roller 3*a* by a pressure application mechanism, in the direction to press the pressure roller 3*a* toward the fixation roller 1. Therefore, a deformation occurs to the pressure roller 3*a*. This deformation renders the fixation nip narrower across the center portion, in terms of the direction parallel to the axial direction of the two rollers, than the end portions. Thus, in order to deal with this problem, that is, in order to compensate for this problem, the pressure roller 3*a* is given such a shape that its diameter is largest (which is 18 mm) at the center in terms of the direction parallel to the axial line of the pressure roller 3*a*, and gradually reduces toward the ends (at which it is 17.8 mm); the difference in diameter between the center and the ends is 200 μm. This shape hereafter may be described as "positively crowned".

More specifically, the positively crowed shape given to the pressure roller 3*a* is such that if the pressure roller 3*a* is seen from the direction perpendicular to its axial line, the contour of the crowned portion of the pressure roller 3*a* forms an arc, the diameter of which is 64 m.

On the exit side of the belt nip, the pressure roller 3*a* is kept pressed against the fixation roller 1 by the application of 200 N of pressure, with the presence of the endless belt 2 between the two rollers. Therefore, the elastic layer 1*b* of the fixation roller 1 is deformed; a deformation is created in the peripheral surface of the fixation roller 1. The interaction of the presence of this deformation $\epsilon$ and the rigidity (resiliency) of the recording medium causes the recording medium P to separate from the fixation roller 1.

Further, the fixing apparatus is structured so that the pressure pad 4 is disposed between the pressure roller 3*a* and heat roller 3*b*, in terms of the direction in which the endless belt 2 is circularly moved. Further, the pressure pad 4 is made up of a base plate 4*a*, and an elastic layer 4*b* as an elastic portion laminated to the top surface of the base plate 4*a*. Moreover, the outward surface of the elastic layer 4*b* is covered is a low friction sheet 4*c* as a member for enabling the endless belt 2 to easily slide on the pressure pad 4. In other words, the pressure pad 4 is a stationary member on which the belt 2 can easily slide. Further, the pressure pad 4 is kept pressed toward the fixation roller 1 with the application of 200 N of pressure generated by an unshown springs. As the abovementioned base plate 4*a*, a piece of stainless plate, which is 20 mm in width (dimension in terms of running direction of belt), 320 mm in length (dimension in terms of direction perpendicular to surface of recording paper), and 5 mm in thickness, is employed, for example. The pressure pad 4 is also positively crowned to compensate for the deformation caused by the applied pressure. That is, the thickness of the base plate 4*a* is 5 mm across the center portion, whereas it is 4.8 mm at the edges. In other words, it is positively crowned by 200 μm.

As the elastic layer 4*b*, a piece of silicon rubber plate, which is 5 mm in thickness and 15° in hardness, is employed. Incidentally, the hardness of this elastic layer 4*b*, which is 15° in Asker C scale, is the result of the measurement of the hardness of the elastic layer 4*b* by a hardness gauge produced by Kohbunshi Kagaku (High Polymer Science) Co., Ltd. to measure the hardness of rubber. The hardness of the elastic layer 4*b* was measured while applying 9.8 N of pressure to the elastic layer 4*b*.

Not only is the low friction sheet 4*c* is desired to be very low in friction, but also, very durable. In this embodiment, the low friction sheet 4*c* is roughly 75 μm thick, and is formed of polyimide resin, which is highly resistant to heat and frictional wear. It is embossed by 200-500 μm at numerous points to adjust the low friction sheet in coefficient of friction. In addition, it is treated with fluorine to further reduce it in the coefficient of friction.

Although polyimide resin was chosen as the material for the low friction sheet 4*c* in this embodiment, any resinous substance may be used as the material for the low friction sheet 4*c* as long as it is excellent in durability and heat resistance, as well as processability. As for the method for embossing the low friction sheet 4*c* and the shape of each boss, any method may be employed as long as it can change the low friction sheet 4*c* in the height and cross section of each boss to adjust the low friction sheet 4*c* in the amount of surface friction. As for the method for fluorinating the surface of the low friction sheet 4*c*, in this embodiment, the low friction sheet 4*c* is coated with fluorinated resin. However, any fluorinating means may be employed as long as it can reduce, as well as adjust, the low friction sheet 4*c* in coefficient of friction. For example, film of fluorinated resin such as PTFE or PFA may be pasted to the sheet of polyimide resin, or fluorine may be directly mixed into the material for the low friction sheet 4*c*. Further, a given material may be differently processed to yield multiple low friction sheets different in coefficient of friction. (Distribution of Coefficient of Friction of Pressure Roller in Terms of Direction Parallel to Axial Line of Pressure Roller)

Next, referring to FIGS. 1(*a*) and 1(*b*), the distribution of the coefficient of friction of the pressure roller 3*a*, and the distribution of the coefficient of friction of the low friction sheet 4*c* as the surface layer of the pressure pad 4, in terms of the direction parallel to their lengthwise direction, will be described.

Figure 1:
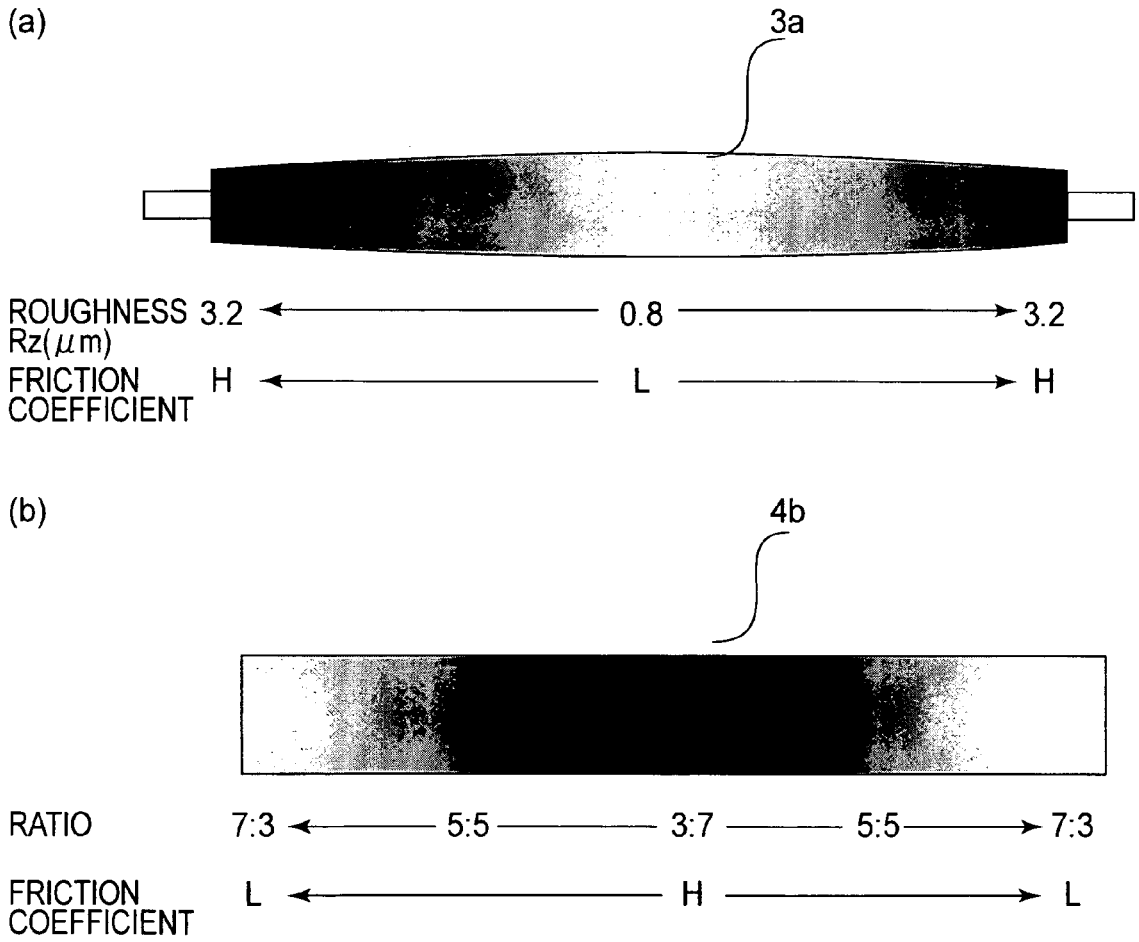
FIG. 1(*a*) is a schematic drawing showing the nonuniformity in the coefficient of friction of the peripheral surface of the pressure roller, in terms of the direction parallel to the axial line of the pressure roller, in the first embodiment of the present invention.

FIG. 1(*a*) is a schematic drawing showing the nonuniformity in coefficient of friction, of the peripheral surface of the pressure roller 3*a*, in terms of the direction parallel to the axial line of the pressure roller 3*a*. FIG. 1(*b*) is a schematic drawing showing the nonuniformity in coefficient of friction, of the low friction sheet 4*c* as the surface layer of the pressure pad 4, in terms of the direction parallel to the axial line of the pressure roller 3*a*.

In this embodiment, in terms of coefficient of friction, the center portion of the pressure roller 3*a* in terms of the direction parallel to its axial line is smaller than the end portions of the pressure roller 3*a*. This relationship between the center and end portions of the pressure roller 3*a* is realized by blasting the peripheral surface of the pressure roller 3*a*. More specifically, in order to render the center portion of the pressure roller 3*a*, in terms of the direction parallel to its axial line, lower in coefficient of friction, than the end portions of the pressure roller 3*a*, the center portion is more finely blasted than the end portions.

Precisely describing, the surface roughness Rz in (JIS B0601: ten point average roughness) of the center portion of the pressure roller 3*a*, in terms of the direction parallel to its axial direction, was set to 0.8 μm, and the surface roughness Rz of the end portions of the pressure roller 3*a* was set to 3.2 μm. The abovementioned blasting process was carried out to realize the pressure roller 3*a*, the surface roughness Rz of which decreases 1.2 μm every 80 mm, starting from the lengthwise ends toward the center. In other words, in this embodiment, the pressure roller 3*a* is less in surface roughness across the center portion, in terms of the direction parallel to its axial line, than the end portions.

On the other hand, the low friction sheet 4*c* was embossed so that in terms of the direction parallel to the axial line of the pressure roller 3*a*, the surface of the low friction sheet 4*c* was divided into three areas different in the boss count to render the end portions smaller in coefficient of friction than the center portion. More specifically, in order to make the low friction sheet 4*c* nonuniform in the coefficient of friction in terms of the direction parallel to the axial line of the pressure roller 3*a*, the above mentioned three areas of the low friction sheet 4*c* were differently embossed to make the three areas different in the ratio in size between the entirety of each area and the portion of each area occupied by the bosses; the two end areas were embossed so that the ratio became 7:3; the center area was embossed so that the ratio became 3:7; and the two portions between the end portions and center portion was embossed so that the ratio became 5:5. In this embodiment, the end portions of the low friction sheet 4*c*, in terms of the direction parallel to the axial line of the pressure roller 3*a*, were made lower in coefficient of friction than the center portion of the low friction sheet 4*c*.

Figure 3:
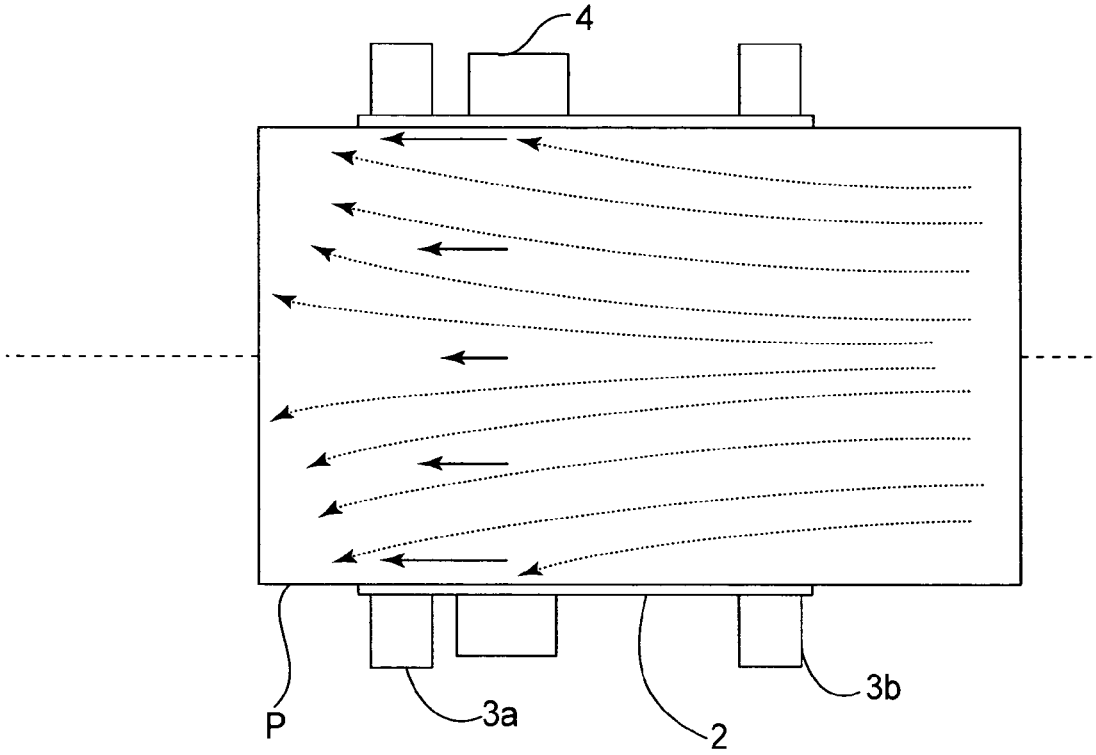
FIG. 3 is a schematic drawing showing how the recording medium behaves while it is moved through the fixing apparatus in the first embodiment of the present invention.

Next, referring to FIG. 3, what occurs to the recording medium P while the recording medium P is moved at a preset speed through the fixing apparatus of the belt-nip type, which is made up of the pressure roller 3*a* and low friction sheet 4*c*, which are nonuniform in coefficient of friction in terms of the direction parallel to the axial line of the pressure roller 3*a*, will be described. FIG. 3 is a schematic drawing showing what occurs to the recording medium P while the recording medium moves through the fixation nip of the fixing apparatus in this embodiment.

Referring to FIG. 3, the force F which the fixation roller 1 applies to the endless belt 2 is nonuniformly distributed across the endless belt 2, because the coefficient of friction of the peripheral surface of the pressure roller 3*a* is higher across the end portions of the pressure roller 3*a*, in terms of the direction parallel to its axial line, than across the center portion of the pressure roller 3*a*. Thus, the force applied by the endless belt 2 to the pressure roller 3*a* in the direction to rotate the pressure roller 3*a* in the recording medium conveyance direction is nonuniform in terms of the direction parallel to the axial line of the pressure roller 3*a*.

Therefore, during the period immediately after the endless belt 2 begins to be rotated, the center portion of the endless belt 2, in terms of the direction parallel to the axial line of the pressure roller 3*a*, is moved slower than the end portions, as indicated by arrow marks drawn with solid lines, until the elasticity of the belt 2 reaches its limit. As the elasticity of the belt reaches its limit, the center portion of the belt 2 and end portions of the belt 2 begin to move at the same velocity, as indicated by arrow marks drawn with dotted lines, with the belt 2 remaining deformed (remaining waving).

Also referring to FIG. 3, the waving of the endless belt 2 occurs roughly at the center of the endless belt 2, and then travels to the edges of the belt 2. Therefore, as the deformation having occurred to the belt 2 in the nip reaches the edges of the belt 2, it dissolves. Thus, as long as the deformation remains within the range tolerable by the elasticity of the endless belt 2, it does not accumulate, and therefore, it does not occur that the recording medium develops wrinkles while it moves through the fixation nip. Therefore, it is possible to obtain an excellent image.

Figure 4:
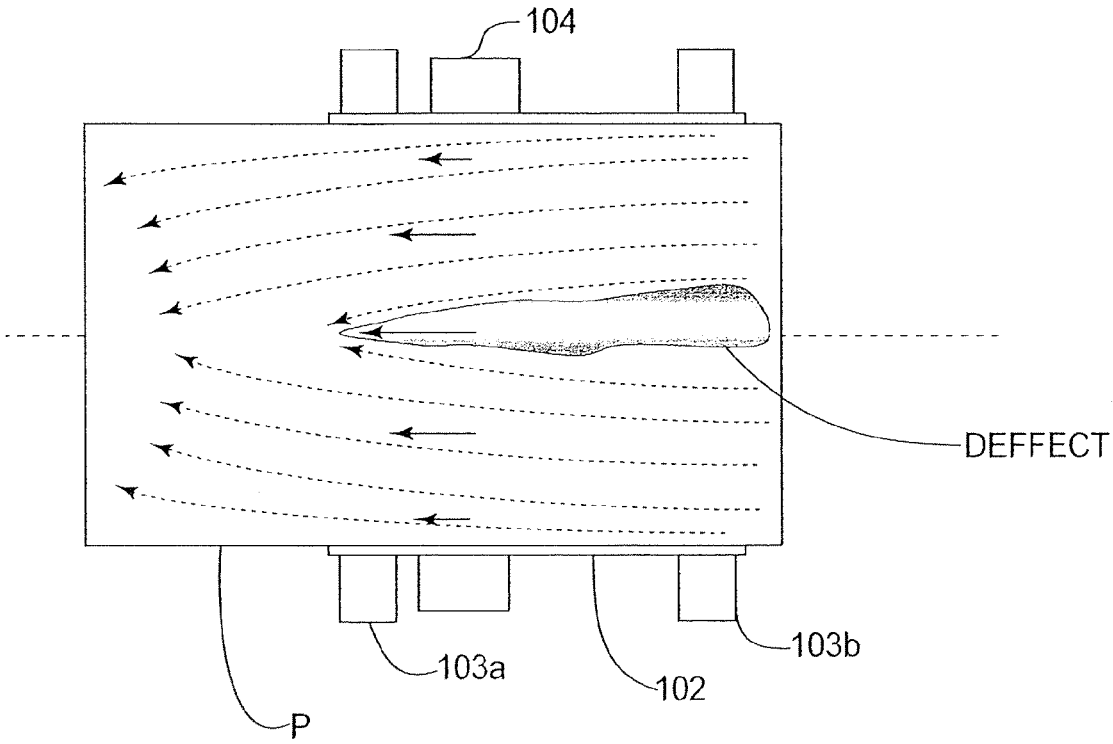
FIG.4 PRIOR ART
FIG. 4 is a schematic drawing showing how the recording medium behaves while it is moved through a fixing apparatus in accordance with the prior art.
Figure 5:
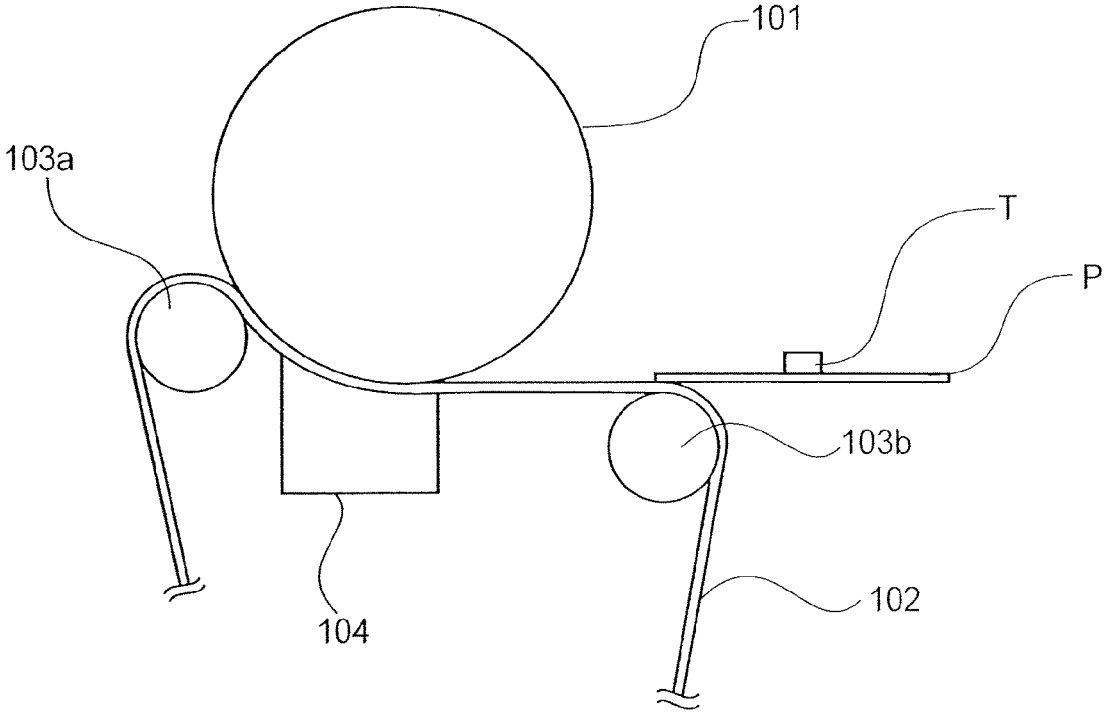
FIG.5 PRIOR ART
FIG. 5 is a schematic sectional view of the fixing apparatus in accordance with the prior art.
Figure 6:
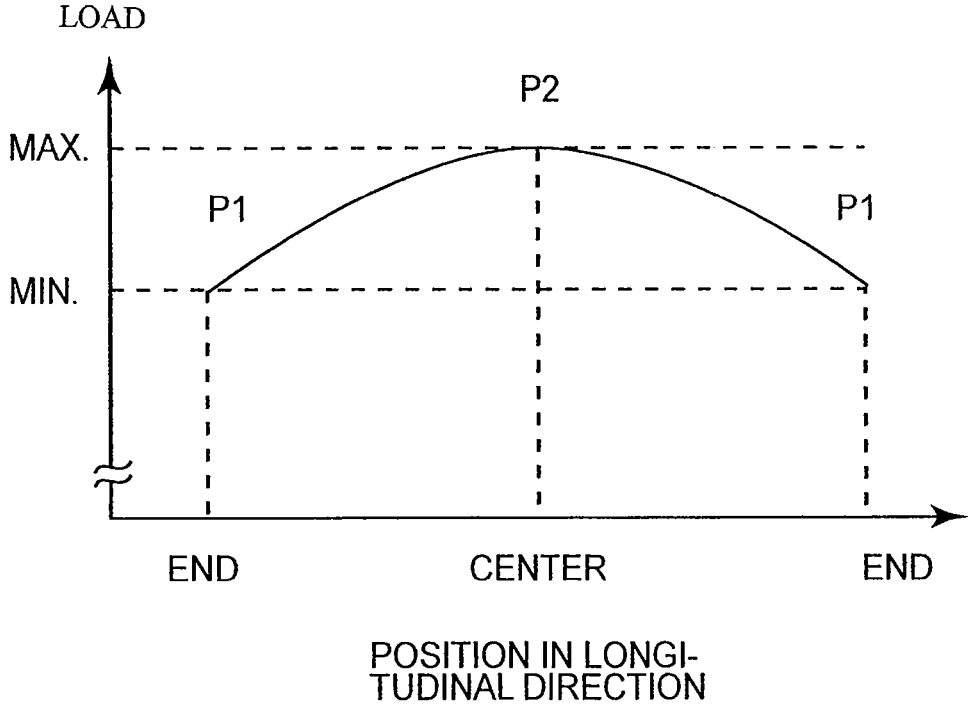
FIG.6 PRIOR ART
FIG. 6 is a graph showing the distribution of the pressure, in terms of the direction parallel to the axial line of the pressure pad, exerted by the pressure pad of the fixing apparatus in accordance with the prior art.

FIG. 4 is a schematic drawing showing what occurs to the recording medium P while it moves through the fixation nip of the fixing apparatus in accordance with the prior art. As will be evident from FIG. 4, because the coefficient of friction of the surface of the pressure pad 104 and the coefficient of friction of the peripheral surface of the pressure roller 3*a* are roughly uniform across their entire ranges in terms of the direction parallel to the axial line of the pressure roller 3*a*, the force F which the fixation roller 1 (unshown) applies to the endless belt 2 is uniformly distributed across the endless belt 2. Therefore, the waving of the endless belt 2 begins at the end portions of the belt 2, and travels toward the center portion of the belt 2, because of the difference in the velocity between the end portions of the belt 2 and the center portion of the belt 2, which results from the difference in diameter between the end portions of the pressure roller 3*a*, and the center portion of the pressure roller 3*a*. Consequently, while the recording medium P moves through the fixation nip, the stress generated in the belt 2 manifests as a force large enough to cause the recording medium to wrinkle, or a force which is not large enough to cause the recording medium to wrinkle, but, large enough to cause the image forming apparatus to yield a defective image.

On the other hand, in this embodiment, the center portion of the pressure roller 3*a* in terms of the direction parallel to its axial line is rendered different in coefficient μ of friction from the end portion, as described above. Therefore, not only is it possible to prevent the recording medium P from developing wrinkles while it moves through the fixing nip, but also, it is possible to prevent the positional image deviation.

In other words, the pressure roller 3*a* is positively crowned to optimize the fixation nip in terms of width, and further, it is rendered nonuniform in coefficient of friction in terms of the direction parallel to its axial line. Therefore, the nonuniformity in the force which works between the pressure roller 3*a* and endless belt 2 in the direction parallel to the recording medium conveyance direction is minimized. Therefore, not only is it possible to prevent the positional image deviation, but also, it is possible to prevent the wrinkling of the recording medium.

That is, with the employment of the structural arrangement in this embodiment, it is possible to provide a fixing apparatus which is unlikely to cause the recording medium to wrinkle, and also, is excellent in image fixation performance.

Incidentally, in the above, the present invention, which relates to an image heating apparatus, was described with reference to the fixing apparatus as an example of an image heating apparatus. However, the present invention is also applicable to an image heating apparatus structured to temporarily fix a toner image to recording medium by heating the toner image, and an image heating apparatus structured to reheat the fixed image on recording medium in order to improve the fixed image in glossiness.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 134424/2005 filed May 2, 2005 which is hereby incorporated by reference.

What is claimed is:

1. A fixing apparatus comprising:

a rotatable fixing member and a rotatable pressing belt configured to fix an unfixed toner image on a sheet at a fixing nip therebetween, said pressing belt is disposed so as to contact with a side opposite to a side of the sheet on which the unfixed toner image is formed;

a roller, disposed opposed to said fixing member through said pressing belt at the fixing nip, configured to rotatably support said pressing belt, said roller being pressed at end portions toward said fixing member;

wherein said roller has a diameter which is larger at an axially central portion thereof than at the axially end portions thereof; and wherein said roller has a friction coefficient which is larger at the axially end portions than at the axially central portion, and wherein a portion between one of the axially end portions and the axially central portion has a friction coefficient which is smaller than the friction coefficient at the axially end portion and which is larger than the friction coefficient at the axially central portion.

2. An apparatus according to claim 1, wherein said roller has a surface roughness Rz which is smaller at the axially central portion than at the axially end portions, and wherein said portion between the axially end portion and the axially centrally portion has a surface roughness Rz which is smaller than a surface roughness Rz at the axially end portion and which is larger than a surface roughness Rz at the axially central portion.

3. An apparatus according to claim 1, further comprising a pad configured to press said pressing belt toward said fixing member at the fixing nip, wherein said roller is disposed at a position where the sheet is separated from said pressing belt.

* * * * *